US009681685B1

(12) United States Patent
Giordano

(10) Patent No.: US 9,681,685 B1
(45) Date of Patent: Jun. 20, 2017

(54) SELF-LIGHTING PIPE WITH REMOVABLE LIGHTER

(71) Applicant: Cal C. Giordano, Juneau, AK (US)

(72) Inventor: Cal C. Giordano, Juneau, AK (US)

( * ) Notice: Subject to any disclaimer, the term of this patent is extended or adjusted under 35 U.S.C. 154(b) by 155 days.

(21) Appl. No.: 14/455,575

(22) Filed: Aug. 8, 2014

(51) Int. Cl.
*A24F 3/00* (2006.01)
*A24F 47/00* (2006.01)
*F23Q 2/32* (2006.01)

(52) U.S. Cl.
CPC . *A24F 3/00* (2013.01); *F23Q 2/32* (2013.01)

(58) Field of Classification Search
None
See application file for complete search history.

(56) References Cited

U.S. PATENT DOCUMENTS 2,578,061 A * 12/1951 Greenblatt ..... A24F 3/00 131/185
2,588,034 A * 3/1952 O'Neill, Jr. ..... A24F 3/00 131/185
3,351,067 A * 11/1967 Lowenthal ..... A24F 1/02 131/184.1
4,146,042 A * 3/1979 Maiorana ..... A24F 5/00 131/185
5,308,240 A * 5/1994 Lowenthal ..... F23Q 2/163 431/131
7,694,685 B1 * 4/2010 Jones ..... A24F 3/00 131/185

* cited by examiner

*Primary Examiner* — Phu Nguyen
(74) *Attorney, Agent, or Firm* — Michael J. Tavella

(57) ABSTRACT

A pipe that has a machined body that accepts a standard disposable type lighter. A mouthpiece fits in the bottom of the machined body. The mouthpiece has a tube that collects smoke from the bowl and also has a flared end so the smoker can extract the smoke. The end of the mouthpiece is also used to secure the lighter in place. Once assembled, the user fills the bowl of the pipe, pushes the lighter forward to ignite it and draws the flame into the bowl to light the pipe. Once lit, the user releases the lighter and can then smoke normally.

7 Claims, 10 Drawing Sheets

SELF-LIGHTING PIPE WITH REMOVABLE LIGHTER

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to pipes and particularly to pipes having lighters for self-lighting.

2. Description of the Prior Art

Pipes have been in use for centuries. Normally, the pipes hold tobacco or other smoking substances and have to be lit by external means such as a cigarette lighter or match. Of course, the problem is that one must carry separate lighters and matches in order to use the pipe. Unlike cigarettes or cigars, pipes have the distinction of body into which the smoking material (e.g., tobacco) is deposited. Because of this body, the idea of building a lighter into a pipe has been conceived. Over the years people have made such pipe-lighter combinations. For example, U.S. Pat. No. 2,549,726 teaches a pipe body that has a forward bowl and a cigarette-style lighter built into the reap portion of the bowl body. In use, once the bowl is filled, the user holds the pipe in one hand and ignites the lighter with the other, drawing the flame into the bowl. The problem with this device is that it produces a pipe that is rather unwieldy and large. Also, because it uses a convention type lighter, it must have provisions for refilling the lighter and replacing the flints. U.S. Pat. No. 2,578,061 teaches a pipe that has a lighter installed on the outside of the bowl. The bowl has holes formed in it to allow the flame to enter the side. Although smaller than the device mentioned above, it still produces an odd shaped pipe that is odd in appearance. U.S. Pat. No. 5,417,227 teaches a special pipe that can also be used as a cigarette holder. It has a rotatable body and a combustion chamber. A custom lighter is placed opposite the mouthpiece. In use, the pipe is loaded and the lighter is pushed forward to light it. The body is rotatable such that when the user is finished, the body can be rotated to close the combustion chamber.

U.S. Pat. No. 7,694,685 teaches another type of self-igniting pipe. It has a rectangular body that has a bowl on one end and a lighter in the other end. A rotating mouthpiece is attached to the bottom and it pivots about the bowl. When the mouthpiece is rotated out, it causes the lighter to ignite. Note that the lighter remains lit for the entire time the mouthpiece is rotated out of the body. Another U.S. Pat. No. 8,109,275 teaches a device that has a rotating body that has a bowl and mouthpiece. This is mounted next to a lighter. The unit also contains a small box for holding smoking materials. When the bowl/mouthpiece is rotated upwards, the bowl is aligned with the lighter such that when ignited, the lighter flame will ignite the smoking materials. Finally, two published applications, Pub. Nos. US20070089757 and US20110162663 teach small pipes that essentially slightly larger than a disposable lighter. The designs contain a lighter and a small bowl. An inner pipe leads to a hole in one end that is used as a mouthpiece. These units take the opposite extreme from those initially discussed in that these units are almost too small to be practicable while the older units are too large.

BRIEF DESCRIPTION OF THE INVENTION

The instant invention overcomes these difficulties. It is a pipe that has a machined body that accepts a standard disposable type lighter. A mouthpiece fits in the bottom of the machined body. The mouthpiece has a tube that collects smoke from the bowl and also has a flared end so the smoker can extract the smoke. The end of the mouthpiece is also used to secure the lighter in place. Once assembled, the user fills the bowl of the pipe, pushes the lighter forward to ignite it and draws the flame into the bowl to light the pipe. Once lit, the user releases the lighter and can then smoke normally.

DETAILED DESCRIPTION OF THE INVENTION

Figure 1:
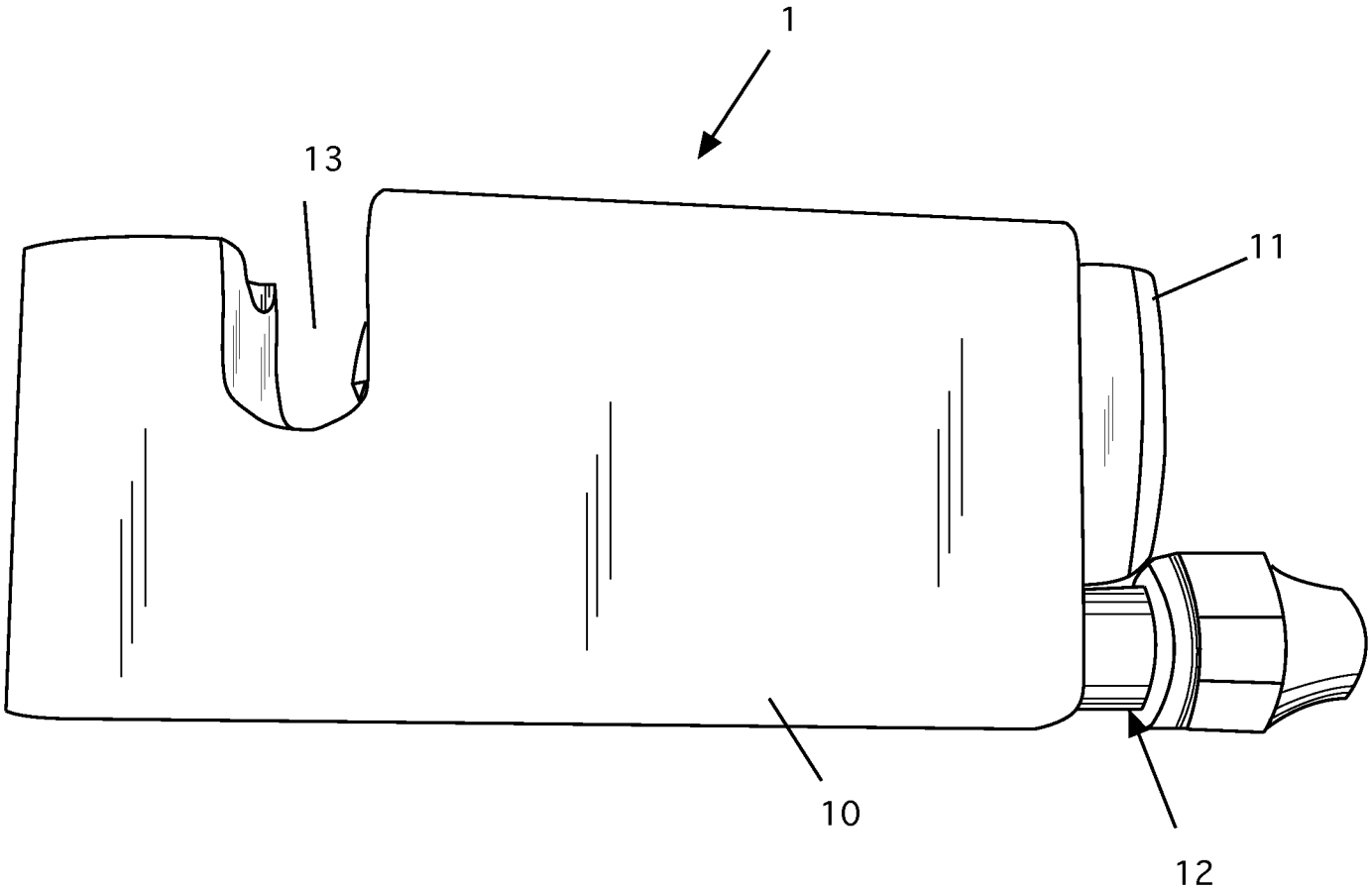
FIG. 1 is a side perspective view of the invention as fully assembled.
Figure 1A:
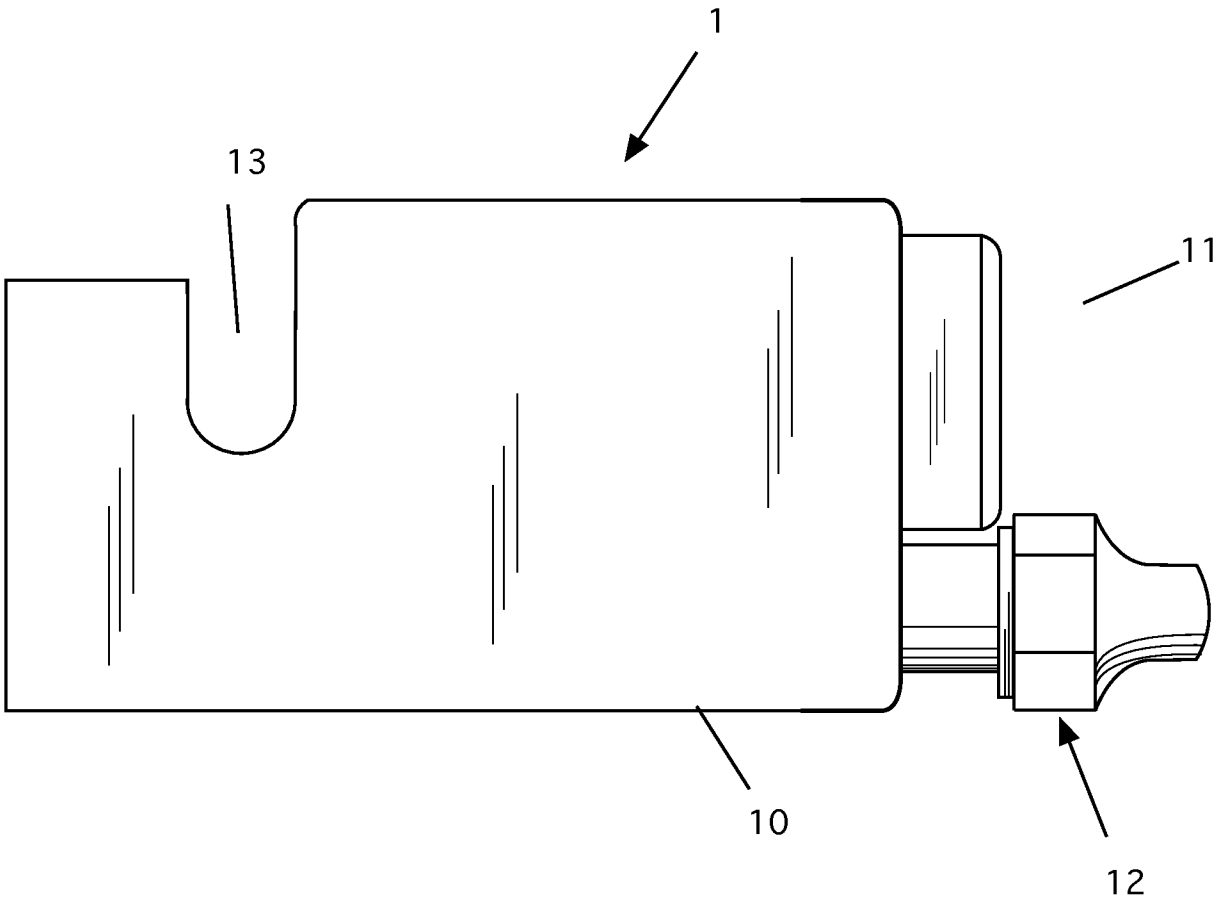
FIG. 1*a* is a side view of the invention as fully assembled.

Referring now to FIGS. 1-5, the invention 1 is a pipe having a machined body, or housing, 10, a lighter 11 and a threaded mouthpiece 12. FIG. 1 shows a side perspective view of the invention 1 as fully assembled and FIG. 1*a* is a side view of the invention as fully assembled. Note that when assembled, the lighter and mouthpiece are largely contained within the machined housing. Only the ends of the lighter 11 and the mouthpiece extend out of the back of the machined body 10 as shown. As discussed below, the mouthpiece has a flared end 12*c* on the rearward end that also acts to lock the lighter in place when the mouthpiece is fully engaged in the machined housing. As shown in FIG. 1, the machined housing 1 is largely rectangular. At the bowl end 10*a*, however, a saddle 13 is formed. This saddle allows the flame of the lighter to enter the bowl.

Figure 2:
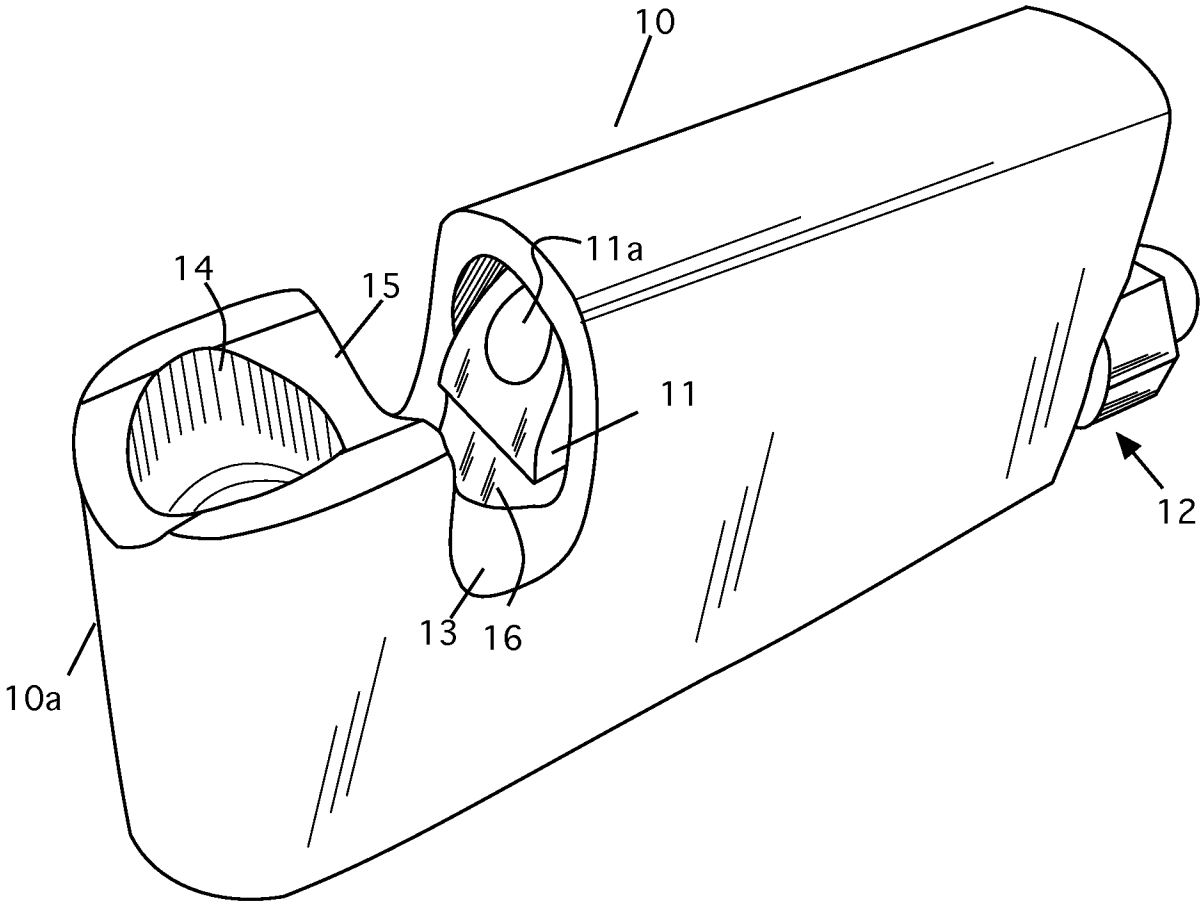
FIG. 2 is a top perspective view of the invention as fully assembled.

FIG. 2 is a top perspective view of the invention as fully assembled. Here, the bowl end 10*a* of the machined body 10 is shown. Note the position of the lighter 11. The lighter has a flame nozzle 11*a* that aligns with a saddle 15 formed in the top portion of the bowl 14. Note the machined housing has an opening 16 formed to fit the top of the lighter as shown.

Figure 2A:
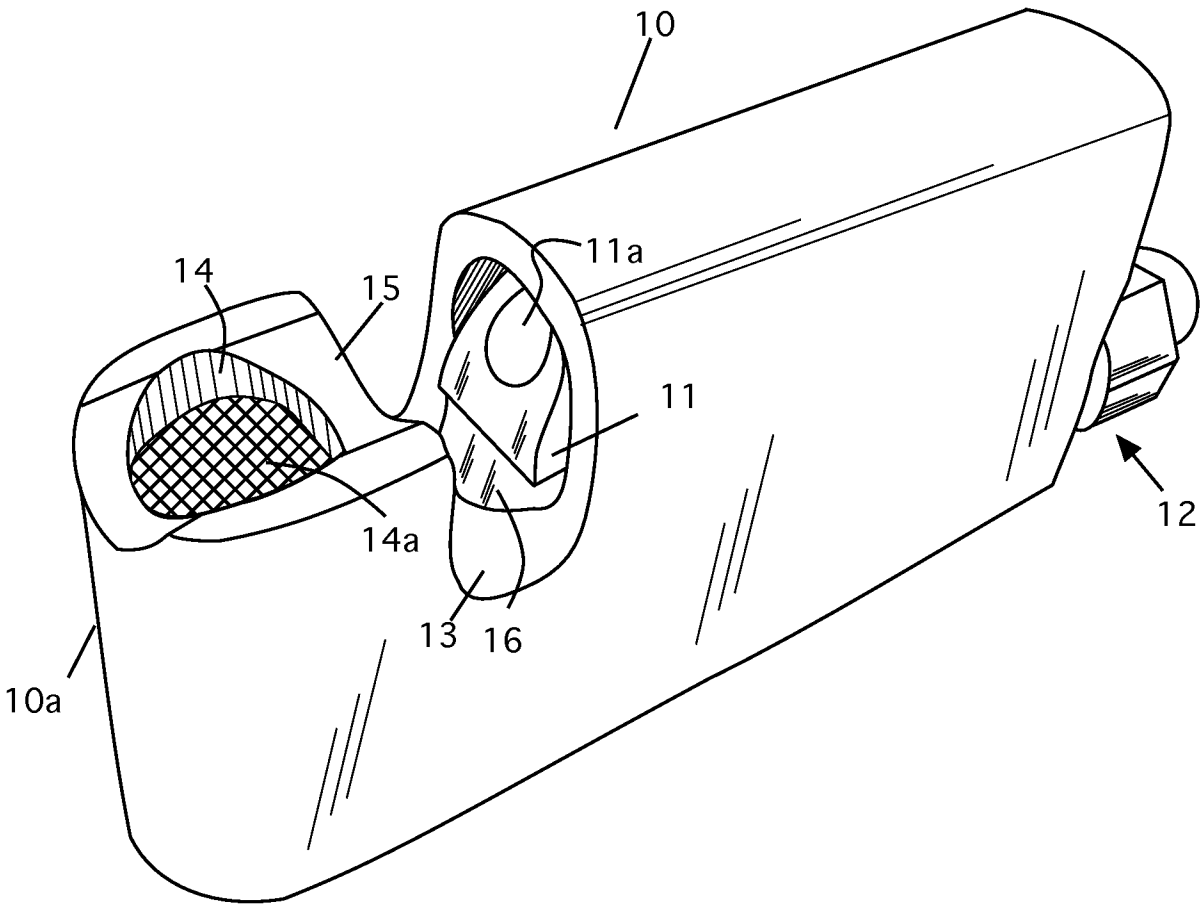
FIG. 2*a* is a top perspective view of the invention that shows an optional screen installed.

FIG. 2*a* is a top perspective view of the invention that shows an optional screen 14*a*. This screen is designed to fit the bowl and any workable screen can be used. Again, the screen is optional and the device can be used without a screen if desired.

Figure 3:
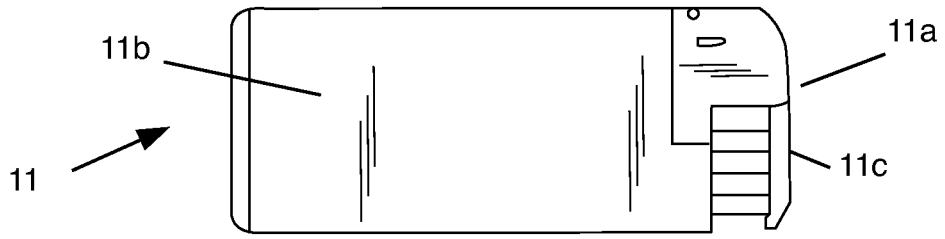
FIG. 3 is a side view of the lighter used in the invention.
Figure 4:
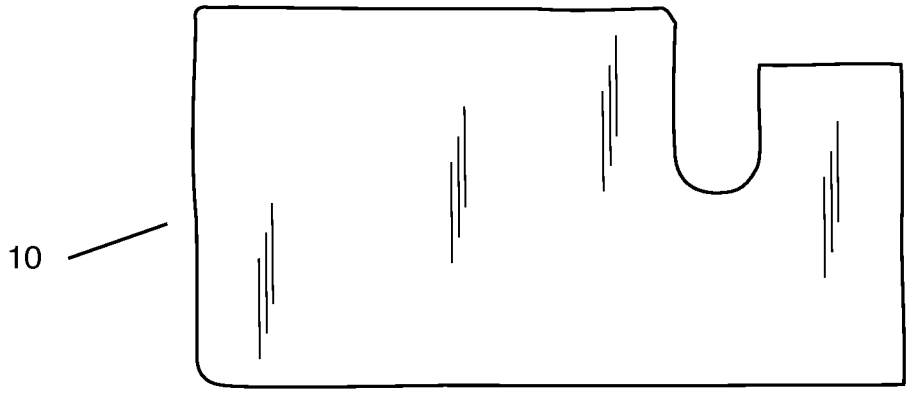
FIG. 4 is a side view of the machined body of the invention.
Figure 5:
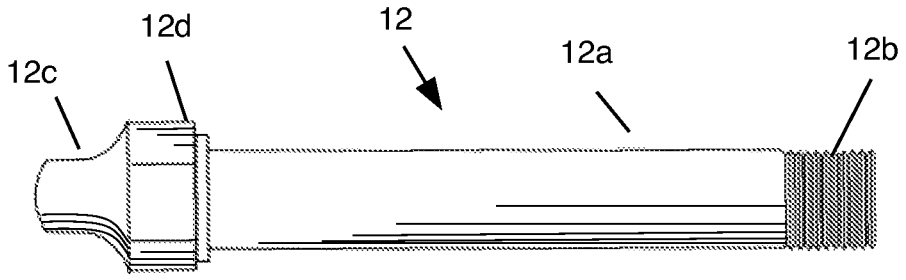
FIG. 5 is a side view of the threaded mouthpiece of the invention.

FIG. 3 is a side view of the lighter 11 used in the invention. In the preferred embodiment, the lighter is a disposable type that has a fuel container 11*b*, a spring-loaded ignition switch 11*c* and the flame nozzle 11*a*, as discussed above. FIG. 4 is a side view of the machined body 10 of the invention. FIG. 5 is a side view of the threaded mouthpiece of the invention. Here, the mouthpiece consists of a straight tube 12*a* that is threaded on one end 12*b* and the flared fitting 12*c* attached to the opposite end as shown. Note that the end of threaded mouthpiece 12 has a flared end 12*c* that is used to puff on the pipe; and a grip portion 12*d* that allows a user to firmly grip the mouthpiece while the user inserts and tightens the mouthpiece in place.

Figure 6:
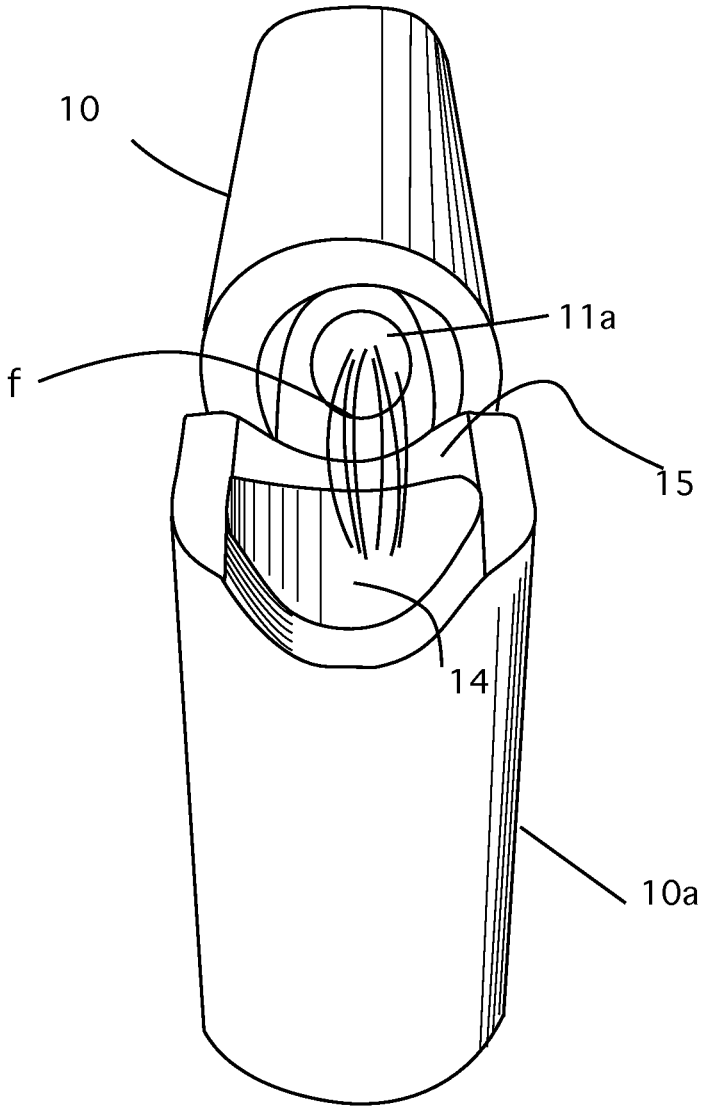
FIG. 6 is a front perspective view of the invention showing the flame from the lighter entering the bowl.

FIG. 6 is a front perspective view of the invention showing the flame from the lighter entering the bowl. Here, the lighter 11 and flame nozzle 11*a* are visible. The bowl 14 is shown with the saddle 15. Note that here, the flame f is shown entering the bowl 14. In ordinary use, the user lights the lighter and pulls the flame into the bowl as in the lighting of any other pipe.

Figure 7:
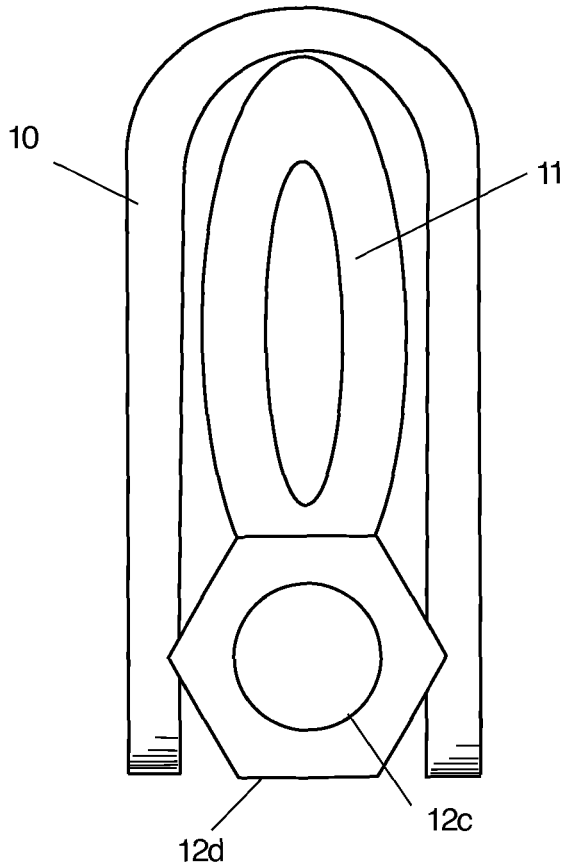
FIG. 7 is a rear view of the invention.

FIG. 7 is a rear view of the invention. Here, the machined housing 10 is shown with the lighter 11 in place and the mouthpiece 12 installed. Note how the grip portion 12*d* fits over the bottom end of the lighter at D. In this way, the lighter is held securely in the machined body 10.

Figure 8:
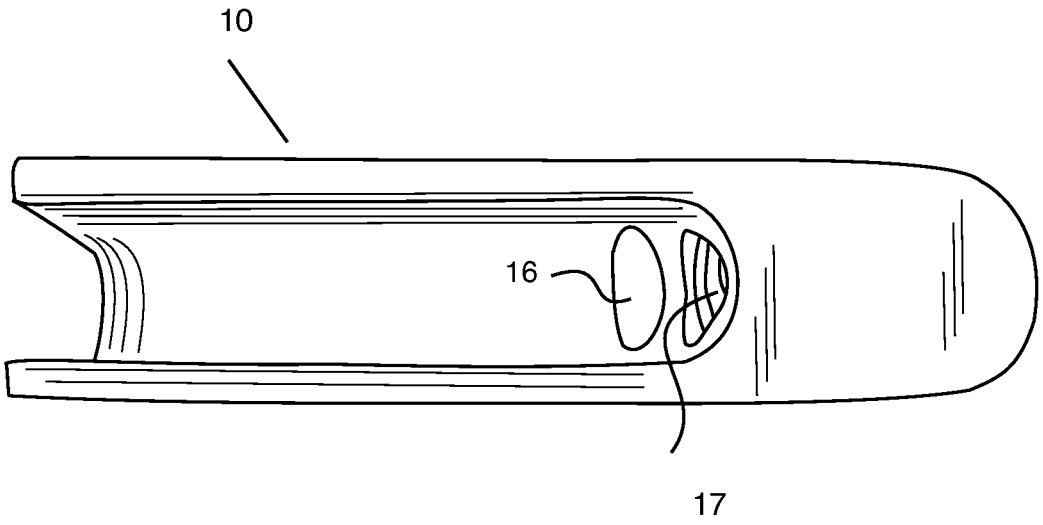
FIG. 8 is an inside view of the machined body.

FIG. 8 is an inside view of the machined body viewed from the bottom. In this view, the machined body 10 has a hollow interior and an open bottom, as shown. Note the opening 16 for the lighter, as discussed above. Note too, the threaded hole 17 formed in the lower portion of the bowl portion 10*a* of the machined body. This threaded hole is used to hold the mouthpiece after the mouthpieces is screwed into the threaded hole 17.

Figure 9:
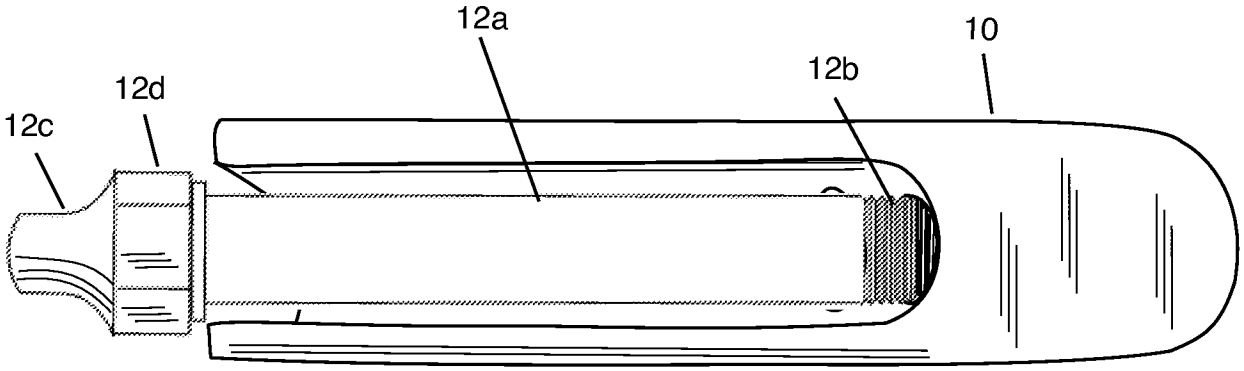
FIG. 9 is a detail view showing the mouthpiece in place for threading into the machined body.

FIG. 9 is a detail view showing the mouthpiece in place for threading into the machined body. In this view, the mouthpiece 12 is shown being screwed into the threaded hole 17. The mouthpiece is simple turned until it seats within the threaded hole 17.

Figure 10:
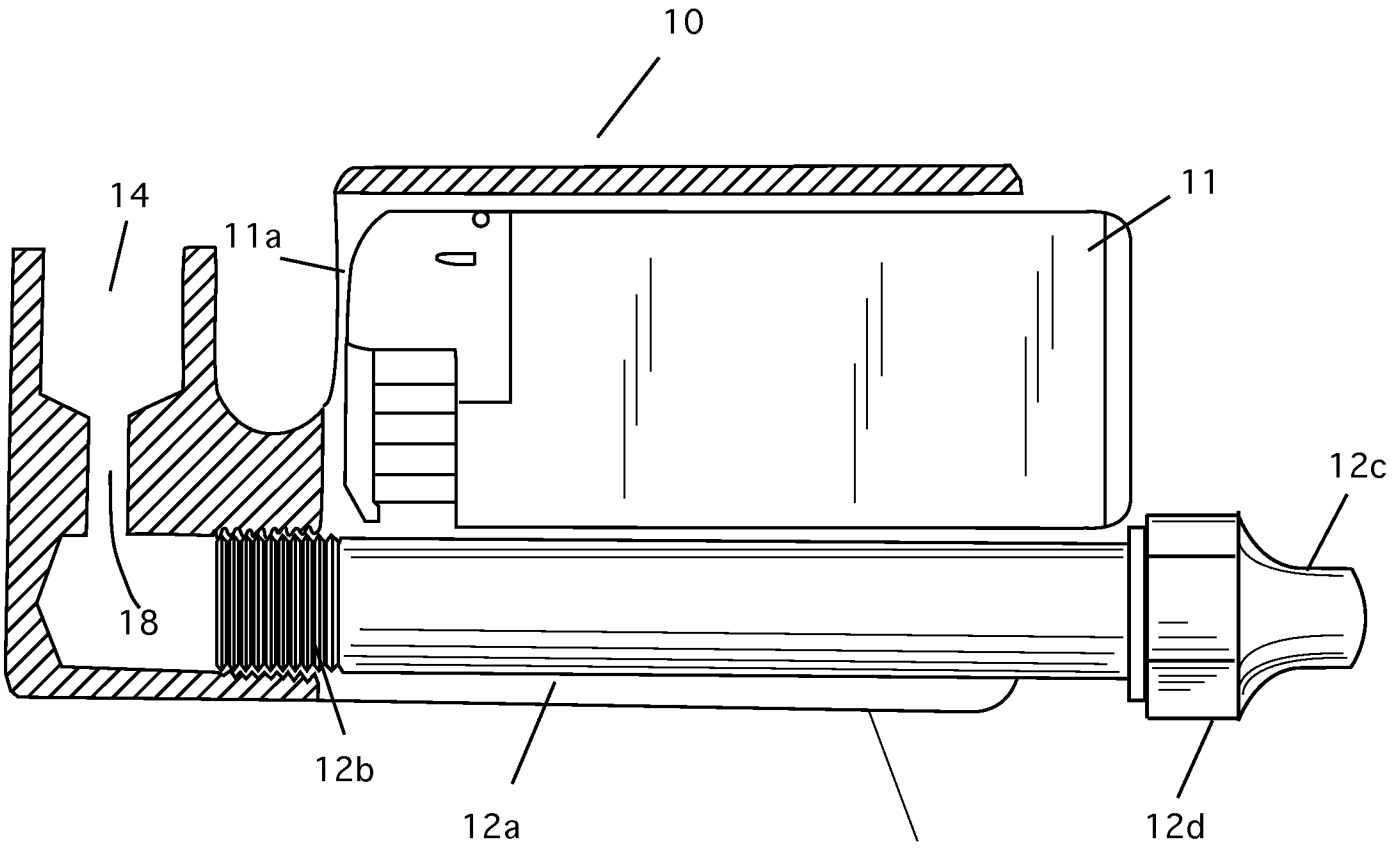
FIG. 10 is a cut away view of the machined body showing the position of the mouthpiece and lighter.

FIG. 10 is a cut away view of the machined body showing the position of the mouthpiece and lighter. Here the machined housing has been cut in half. The lighter 11 is shown in place in the upper portion of the rear of the housing and the mouthpiece 12 is shown in the lower portion with the lighter resting on the tube of the mouthpiece as shown. The bowl 14 is shown. Note that a small channel 18 is machined at the base of the bowl. This channel penetrates through the solid bowl portion of the machined housing as shown. It pierces the top of the threaded hole as shown. When the mouthpiece is fully engaged with the threaded hole it does not penetrate fully into the hole. This allows the smoke from the smoking materials to descend through the channel 18 into the threaded hole 17, where it enters the mouthpiece.

To assemble the invention, a lighter 11 is slid into the top portion of the machined body 10 until it is positioned as shown in FIG. 10. Next the mouthpiece 12 is inserted into the machined body 10 and is screwed into the threaded hole 17 until is it secure. With the mouthpiece 12 in place, the lighter 11 is held in its position.

To use the pipe, after assembling the pipe, a quantity of smoking material is placed in the bowl. The user then pushes the lighter base forward (towards the bowl) until the ignition switch is compressed, causing the lighter to ignite. The user then draws through the mouthpiece to ignite the smoking materials. Once lit, the lighter is released and the user can continue to some normally.

An advantage of this pipe design is that it can be used with one hand. Unlike the self-contained devices discussed above, this pipe can be operated without having to turn or adjust any component. The pipe is lit simply by pushing the lighter forward and pulling on the mouthpiece.

In the preferred embodiment, the machined body is machined from a metal such as aluminum. The threaded mouthpiece is formed from a metal such as brass. However, other materials may be used as desired.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A self-lighting pipe with removable lighter comprising:

a) a housing having a rear portion and a front portion, whereby the front portion has a top and lower portion, and also has a generally solid structure and also has a bowl formed therein at the top of the front portion, said bowl having a bottom, said front portion further having a channel formed therein extending from the bottom of the bowl to a threaded cavity formed in the lower portion of said front portion, said rear portion being a generally hollow body having an open bottom, an open channel adjacent to said bowl and an open back, and further such that said generally hollow body is in communication with said threaded cavity in said front portion of said housing;

b) a lighter, positioned within said generally hollow body and extending rearwards from said open back; and c) a mouthpiece having a tube having distal end and a proximate end, wherein the distal end of said tube is threaded, and further wherein said proximate end has a flared portion formed thereon, said mouthpiece being threadably attached to said threaded cavity formed in the lower portion of said front portion of said housing.

2. The self-lighting pipe with removable lighter of claim 1 wherein said housing having a saddle formed between the top of said front portion and said rear portion.

3. The self-lighting pipe with removable lighter of claim 2 wherein the lighter further comprises: a fuel container, a flame nozzle, and a spring-loaded ignition switch.

4. The self-lighting pipe with removable lighter of claim 3 wherein said saddle further includes an opening therein between said bowl and said rear portion.

5. The self-lighting pipe with removable lighter of claim 4 wherein the flame nozzle of said lighter is in operable communication with the saddle and the bowl through the opening formed in said saddle.

6. The self-lighting pipe with removable lighter of claim 1 wherein the flared portion of said threaded mouthpiece further comprises: a flared end and a grip portion.

7. The self-lighting pipe with removable lighter of claim 1 further comprising a screen inserted into said bowl.

* * * * *